United States Patent [19]

Howard

[11] Patent Number: 4,595,323

[45] Date of Patent: Jun. 17, 1986

[54] FLOATING LOADING SYSTEM

[76] Inventor: William M. Howard, 5214 Hedden Cir., Middleton, Wis. 53562

[21] Appl. No.: 784,735

[22] Filed: Oct. 7, 1985

Related U.S. Application Data

[63] Continuation of Ser. No. 557,475, Dec. 2, 1983, abandoned.

[51] Int. Cl.[4] ..... B60D 7/12; B61D 45/00

[52] U.S. Cl. ..... 410/36; 410/42; 410/88; 410/91

[58] Field of Search ..... 410/2, 32, 36, 37, 34, 410/42, 47, 87, 88, 90, 91

[56] References Cited

U.S. PATENT DOCUMENTS

| | | | |
|---|---|---|---|
| 2,047,954 | 7/1936 | Fitch | 410/88 |
| 2,047,955 | 7/1936 | Fitch | 410/88 |
| 3,004,746 | 10/1961 | Swingle | 410/36 |
| 3,263,830 | 8/1966 | Anderson | 410/36 |
| 3,273,516 | 9/1966 | Trumper et al. | 410/87 |
| 3,601,866 | 8/1971 | Odin | 410/91 |

FOREIGN PATENT DOCUMENTS

| | | | |
|---|---|---|---|
| 0992265 | 2/1983 | U.S.S.R. | 410/37 |

*Primary Examiner*—Robert B. Reeves
*Assistant Examiner*—Donald T. Hajec

[57] ABSTRACT

While the present invention may be used in a variety of applications, is is particulary well suited for use in loading elongate loads, such as hollow concrete utility poles, onto railroad cars. The system of the present invention protects the load, as well as the car, from damage when the car is coupled at either end to a locomotive or another car. The system includes a floating support beam which extends across the car and onto which the load is attached. The beam is held to the car by a plurality of cables or springs so that it can move if a shock is applied to either end of the car. The load may also be secured to the car using conventional strapping techniques, so long as any such technique permits limited longitudinal movement of the load on the car.

3 Claims, 6 Drawing Figures

10
12
14
15
16
17
18
19
20
22
23
26
32
50
52
60
61
62
63
65
66
68
3
4
5

FLOATING LOADING SYSTEM

CROSS-REFERENCE TO RELATED APPLICATIONS

This is a continuation of application Ser. No. 557,475, filed Dec. 2, 1983, now abandoned.

BACKGROUND OF THE INVENTION

1. Field of the Invention

The present invention relates generally to the art of loading systems, and more particularly to a system for loading elongate loads onto a carrier vehicle to prevent damage to the load or vehicle if shock forces are applied to either end of the vehicle.

2. Description of the Prior Art

While the present invention has other uses which will be explained later in this specification, the prior art is best illustrated by reference to railroad cars and the loading thereon of elongate loads, such as loads of concrete utility poles. Typically, eight or more of such poles are carried by a single flatbed railroad car. Each of the poles includes a gradually tapering body prepared from concrete and internal reinforcement, such as metal reinforcement rods. The poles may be solid in cross-section or may be hollow.

The past practice for transporting such poles from the factory to the job site has been to use a framework secured to one end of the car and onto which the poles are secured by a plurality of pins and spacers. The framework is usually secured at the end of the car carrying the larger ends of the poles (the end which is placed in the ground). Straps are provided at other locations along the car to bind the poles together and to keep the load from shifting from side to side.

While the prior art system provides adequate support and containment for the poles, it suffers from one serious disadvantage. The problem occurs when the railroad car is coupled to or uncoupled from adjoining cars, and as is well known, such coupling or uncoupling is accompanied by shock forces on the car and load. Because the load is secured to the car bed, those shock forces are transmitted directly to the poles and cause damage to the poles themselves. The damage may be catastrophic, e.g., actual breakage, or it may be less apparent and potentially more significant, as for example, if the poles develop cracks which do not immediately manifest themselves but which later reduce the structural integrity and safety of the poles. Such damage has resulted in claims involving the railroad carriers and pole manufacturers. A loading system which reduces such shock damage and the potential for such claims would represent a significant advance in the art.

OBJECTS AND SUMMARY OF THE INVENTION

It is a primary object of the present invention to provide a loading system which overcomes the aforesaid disadvantages of the prior art.

Another object of the present invention is to provide a loading system which reduces damage to a load carried if shock forces are applied to the carrier vehicle.

A further object of the present invention is to provide a loading system which may be adapted to a variety of load carrying applications and which may be removably attached to railroad cars.

How these and other objects of the present invention are accomplished will be described by reference to the following specification, taken in conjunction with the drawings. Generally, however, the objects are accomplished by employing a floating support member extending across the carrier vehicle onto which the load is attached. The support member may be an I-beam and may include legs which are attached to the beam. The beam is attached to the car by a plurality of cables or springs which extend from the beam toward each end of the car, the cables and springs permitting limited movement of the beam following a shock and return of the beam to its initial position when the shock force is removed.

DESCRIPTION OF THE PREFERRED EMBODIMENT

Figures 1, 2:
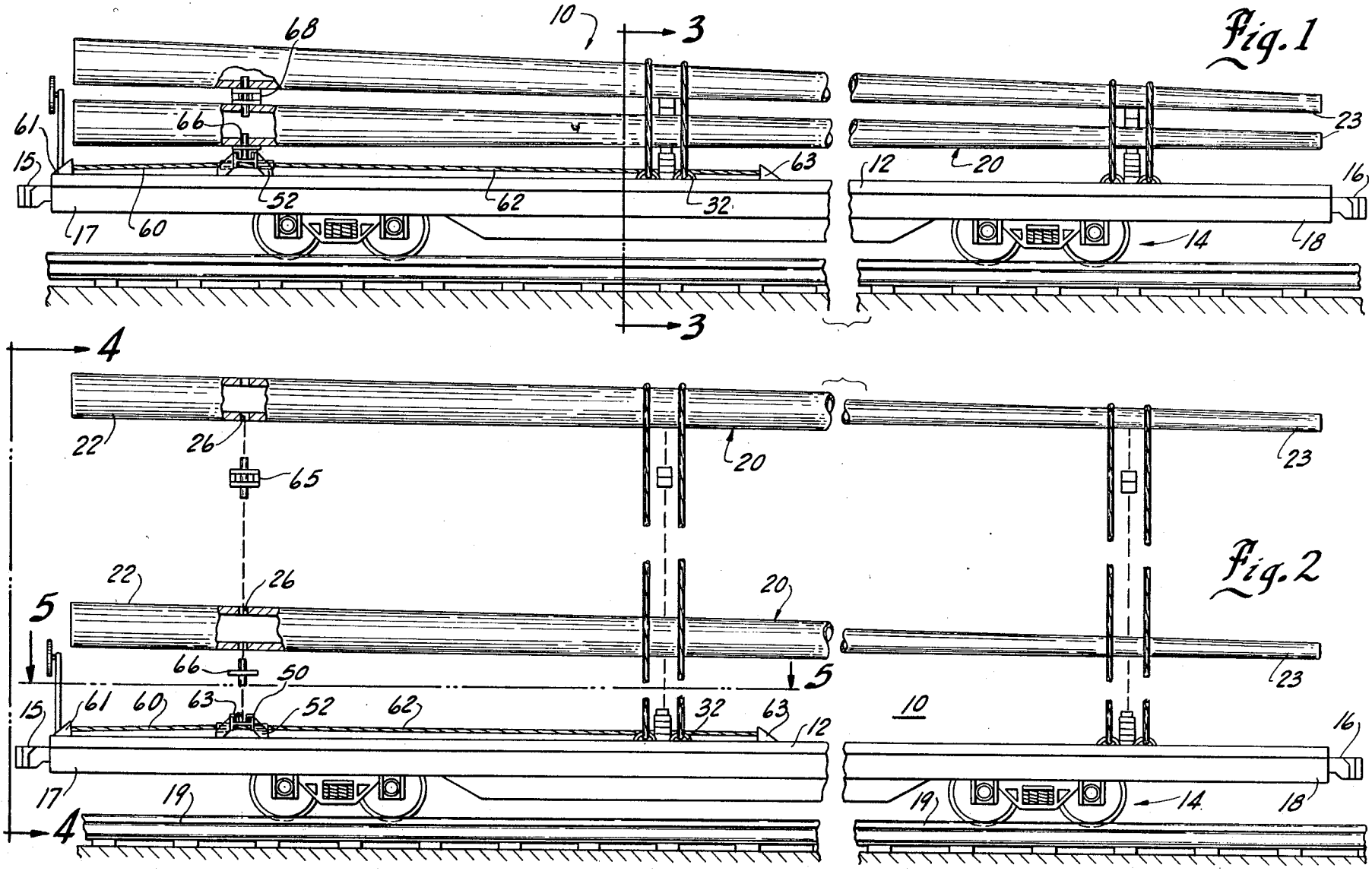
FIG. 1 is a side elevation view of a railroad car holding a load of telephone poles.
FIG. 2 is a view similar to FIG. 1 with the poles exploded from their normal position to illustrate certain features of the present invention.

FIG. 1 illustrates a normal flatbed railroad car 10 including a bed 12, wheel trucks 14 and coupling members 15 and 16 at the left and right ends 17 and 18 respectively of car 10. The car rides on track 19. Carried by car 10 is a load of eight hollow, concrete utility poles 20, each of which tapers from a large end 22 near end 17 of car 10 to a smaller diameter end 23 near end 18 of the car. The particular shape of the poles is not important to the present invention as they may be variously embodied. The illustration is, however, of a typical configuration. In use, the large end 22 is placed in the ground while the upper end 23 is provided for attachment of the utility line support members (not shown). It will also be apparent from FIG. 2 that each of poles 20 includes a pair of holes 26 near the end portion 22 and spaced inwardly therefrom. The holes are provided solely for loading purposes. Since they are located below ground level when the poles are in use, they do not interfere with normal pole function.

Figure 3:
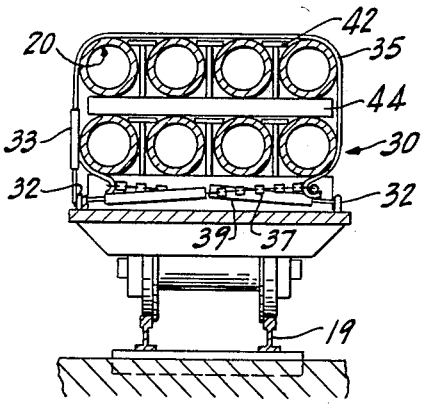
FIG. 3 is cross-section taken along the line 3—3 of FIG. 1 and illustrating a pole strapping technique which may be used with the floating loading system of the present invention.
Figure 4:
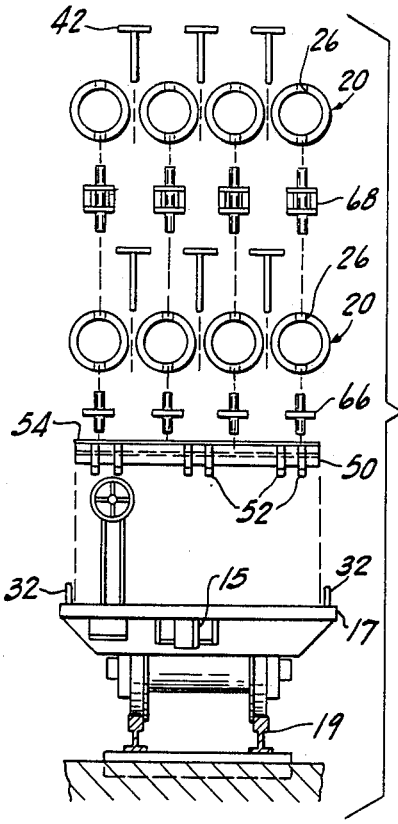
FIG. 4 is end-section taken along the line 4—4 of FIG. 2 showing the pole attachment means of the present invention.

Dealing next with FIG. 3, a typical pole strapping system 30 is used to assist in holding poles 20 onto car 10. System 30 is used three times in the illustrated embodiment of FIG. 1 and along the length of car 10. They differ only slightly because the diameter of poles 20 decreases along the length of car 10. The size of the spacers and internal supports will decrease as the distance from end 17 increases.

Each of system 30 include a pair of eye hooks 32, one affixed to the near and one to the far edge of car 10 and longitudinally spaced apart from one another. A turnbuckle 33 is attached to each of hooks 32. A cable strap 35 is attached to turnbuckle 33 and passes around the group of eight poles 20 so that it extends just below the outside, lower pole on the opposite side of car 10. At that point, a chain 37 is releasably coupled to the end of strap 35 and to hook 32. It will be appreciated from this description that the cable 35 may be tightened about poles 20 by adjustment of turnbuckle 33.

It is also apparent from FIG. 3 that the bottom row of poles is elevated somewhat from the bed 12 of car 10, and it is typical that one or more pieces of lumber 39 are provided for this purpose. They extend between the sides of car 10 and intermediate hooks 32. The height of lumber pieces 39 will increase for each of systems 30 as the diameter of the poles 20 decrease.

Systems 30 are similar to those used in the prior art, and, therefore, have not been described in detail. It will suffice here to say that the pair of oppositely directed cables will hold the poles on the car and prevent side to side movement. Limited longitudinal movement of poles 20 will be possible due to the inherent flexibility of the cables 35 and chain 39.

It will also be apparent from FIG. 3 that poles 20 are spaced apart from one another by a series of six t-shaped spacers 42 and by a length of wood or other suitable spacer 44 located between the upper and lower rows of poles 20. This particular aspect of the invention is also known in the prior art and any known system of cushioning the poles can be employed.

Figure 6:
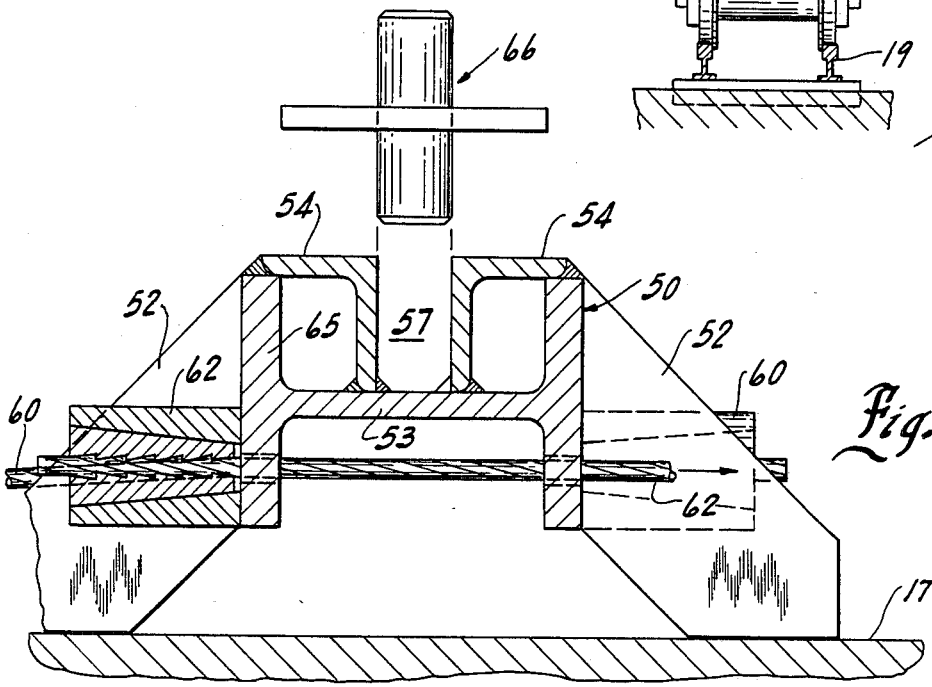
FIG. 6 is a view taken along the line 6—6 of FIG. 5 showing the details of support beam of the present invention.
Figure 5:
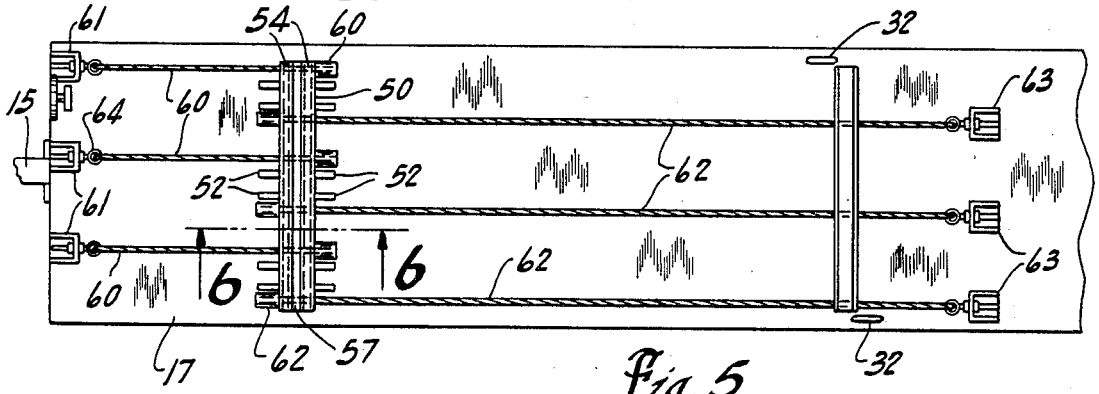
FIG. 5 is a top plan view taken along the line 5—5 of FIG. 2 showing the support beam of the present invention and the cables used to attach the support beam to the railroad car.

The unique features of the present invention will be described by reference particularly to FIG. 6. The principle feature is a support beam 50, which may be made from a variety of suitable materials, but which in the preferred embodiment is a metal I-beam. It extends across the width of car 10 and is located inwardly from end 17 but generally near the left end of car 10. Beam 50 is spaced several inches above bed 12 by a plurality of legs 52 which extend downward from beam 50. The bottom of legs 52 rest on bed 12. In the illustrated embodiment, twelve feet 52 are provided with three sets of two feet 52 extending from each side of beam 50.

Beam 50 is an I-beam lying on its side so that web 53 is horizontal. A pair of right angle members 54 having a length equivalent to that of beam 50 are welded to the web and to the upper flanges 56 of beam as is illustrated in FIG. 6 so that an elongate slot 57 is provided along the top of beam 50. Other techniques for fabricating a slotted support beam 50 may also be employed.

Beam 50 is held on bed 12 by two sets of cables or springs 60 and 62. Three cables 60 extend from beam 50 and are attached to three anchors 61 located adjacent end 17 of car 10. Cables 62 extend from beam 50 and are attached to three anchors 63 which are located near the central portion of car 10. The cables 60 and 62 are secured to beam 50 using jaw type clamps 62 and to the anchors 61 and 63 using fasteners 64. Other known cable fasteners can be substituted for those shown. From this description, it will be apparent that beam 50 "floats" on bed 12 and is free to move a limited distance in either direction due to the inherent give of cables 60 and 62 (which may be on the order of an inch to several inches).

Poles 20 are held to beam 50 using a system of two-ended pins as will now be described. The first attachment is between the bottom row of poles and beam 50 by means of four double-ended pins 66 which are inserted in holes 26 of poles 20 and into slot 57 in beam 50. Spacers of the t-shaped type 42 as used in system 30 are also employed between adjacent poles 20 to separate them.

The two rows of poles are coupled by double ended pins 68 adapted to join the top hole 26 of the bottom row of poles with the bottom hole 26 of the top row of poles. Additional t-shaped spacers 42 are employed between the top poles as aforesaid.

From this description, it will be apparent that poles 20 have been attached to beam 50 in a manner which provides a degree of limited longitudinal restraint. However, unlike prior art applications, in the present invention, the support beam 50 may move independently of the bed 12 of car 10 if the car jerks one way or the other. Accordingly, longitudinal shock forces are absorbed and the load is protected.

A number of variations to the present invention are possible and are deemed by the present inventor to fall within its scope. First, the system could be used with a variety of vehicles other than railroad vehicles, i.e., trucks, to protect delicate loads. Moreover, the system may be used with a variety of types of load articles which could be damaged under shock conditions. In addition, the present system is beneficial not only from the standpoint of the load but also from the standpoint of damage to the carrying vehicle. This is so because if the load is rigidly attached to the car, and if a shock force is applied, the load can rip the load constraint system from the vehicle or can cause serious damage thereto.

Furthermore, a number of variations can be made to the system itself, such as by use of coil or other spring material in place of the cables shown. It can also be stated here that the longer the cable or spring, the more flexibility will be provided. To provide such additional flexibility, for example, cables 60 can be longer than those shown and may pass around pulley located at end 17 of the car. The cable will then pass around the pulley and be attached to the underside of the car, thereby more nearly equalizing the length of cables 60 and 62 while maintaining the beam 50 at the location shown in the FIGURES.

Beam 50 need not always be located at one end of the car, although that location is preferred for concrete utility poles. For other types of loads, beam 50 could be located at a different location. For some application, it may be desirable to provide several beams 50 and sets of cables along the length of the car.

So while the present invention has been described by reference to a single preferred and illustrated embodiment, it is not to be limited thereto but is to be limited solely by the claims which follow.

I claim:

1. A system for attaching a load of elongate utility poles to the surface of a flatbed car consisting essentially of:

a beam member extending across the longitudinal axis of said car and above the surface of said car, said beam member being located near to but spaced apart from a first end of said car;

a plurality of anchor means, said anchor means being located on said surface of said car, a portion of said anchor means being spaced apart from and located on both sides of said beam member;

separate elongate cables secured between each of said anchor means and said beam members;

a plurality of utility poles, each of said utility poles including holes generally adjacent to but spaced apart from a first end of said poles;

holes in said beam member, said holes in said utility poles, and said holes in said beam member being arranged in such a manner that the hole of a particular utility pole is located above a hole in said beam member when said utility pole is supported by said beam member; and pin means adapted for being inserted into said holes of said utility poles and said beam member to join said poles to said beam member.

2. The system set forth in claim 1 further comprising leg means for said beam means whereby said beam means is spaced apart from said surface.

3. The invention set forth in claim 1 wherein said elongate cables comprise spring means.

* * * * *